US005842510A

United States Patent [19]

Nagashima et al.

[11] Patent Number: 5,842,510

[45] Date of Patent: Dec. 1, 1998

[54] APPLICATION METHOD OF POWDER STATE MOLD LUBRICANT TO DIE-CASTING MOLD AND DIE-CASTING APPARATUS

[75] Inventors: Katsuo Nagashima, Shibata; Shinichi Oomachi, Natori; Fumihiro Sakuma, Shiroishi, all of Japan

[73] Assignee: Keihin Corporation, Tokyo, Japan

[21] Appl. No.: 837,044

[22] Filed: Apr. 11, 1997

[30] Foreign Application Priority Data

Apr. 12, 1996 [JP] Japan ..... 8-115562

[51] Int. Cl.[6] ..... B22D 17/20

[52] U.S. Cl. ..... 164/72; 164/113; 164/267; 164/312

[58] Field of Search ..... 164/72, 149, 267, 164/61, 63, 65, 113, 312, 313, 314, 253, 254

[56] References Cited

U.S. PATENT DOCUMENTS

| | | | |
|---|---|---|---|
| 4,562,875 | 1/1986 | Ogoshi et al. | 164/72 |
| 4,955,424 | 9/1990 | Takehisa et al. | 164/72 |

FOREIGN PATENT DOCUMENTS

| | | | |
|---|---|---|---|
| 1191522 | 4/1965 | Germany | 164/254 |
| 2-151358 | 6/1990 | Japan | 164/313 |
| 3-128159 | 5/1991 | Japan | 164/72 |
| 3-151154 | 6/1991 | Japan | 164/254 |
| 3-151155 | 6/1991 | Japan | 164/254 |
| 4-178254 | 6/1992 | Japan | 164/254 |
| 6-179046 | 6/1994 | Japan | 164/267 |

*Primary Examiner*—J. Reed Batten, Jr.
*Attorney, Agent, or Firm*—Pillsbury Madison & Sutro LLP

[57] ABSTRACT

In a method for applying a powder state mold lubricant onto a die-casting mold, a movable mother die and a stationary mother die are clamped to define a mold cavity with a movable insert die and a stationary insert die, in which a plunger tip slidably arranged within a sleeve opens a molten material supply hole, and communication between the sleeve and the mold cavity is blocked. A pressure within the mold cavity is reduced by opening a powder suction passage opening into the mold cavity and establishing communication between a powder discharge passage communicated with a powder storage source and a molten material supply passage opening to the mold cavity. The powder state mold lubricant is directly within the powder storage source into the mold cavity via the molten material supply passage for applying the powder state mold lubricant on the mold surface of the mold cavity. With such constriction, the powder state mold lubricant will not pass through the chamber or passage having large volume but pass through passages having small volume, the powder state mold lubricant will never fall down to be accumulated within the passage.

7 Claims, 3 Drawing Sheets

2
3
4
5
6
7
8
8A
9
10
10A
10B
10C
11
12
12A
12B
12C
13A
13B
14
14A
15
16
16A
16B
17
17A
17B
18
18A
19
20
21
1A
4A
7A
C
E
X
G
G1
G2
Q
T

APPLICATION METHOD OF POWDER STATE MOLD LUBRICANT TO DIE-CASTING MOLD AND DIE-CASTING APPARATUS

BACKGROUND OF THE INVENTION

1. Field of the Invention

The present invention relates to an application method of a powder state mold lubricant for applying a powder state mold lubricant on a molding surface of a cavity formed by a movable insert die and a stationary insert die, and to a die-casting apparatus suitable for implementing the application method.

2. Description of the Related Art

Conventional application method of powder state mold lubricant has been disclosed in Japanese Examined Patent Publication (Kokoku) No. Heisei 7-63830. In the disclosed method, a mold of a die-casting apparatus is clamped to form a cavity. Then, interior of the cavity is evacuated through an evacuation port communicated to one side of the cavity for reducing the internal pressure in the cavity to suck the mold lubricant into the cavity through a supply passage communicated to the other side of the cavity for applying a powder state mold lubricant on the surface of the cavity. Supply of the powder state mold lubricant to the supply passage is performed through a sleeve, in which a plunger tip is slidably disposed.

In the conventional application method of the powder state mold lubricant, the following problems or drawbacks have been encountered.

(1) The powder state mold lubricant flows into the cavity via the supply line after flowing into the sleeve from a mold lubricant blowing opening formed within the sleeve. In this manner, among the passage for supplying the powder state mold lubricant, a chamber volume in the sleeve is increased for slidably receiving the plunger tip to enlarge the volume. Since the powder state mold lubricant is fine particle mixture solid of wax, talc, graphite and the like and has mass weight, they tends to fall down and is accumulated in the bottom. From this, it is difficult to effectively supply the powder state mold lubricant supplied from the mold lubricant blowing opening into the cavity. Therefore, quite large amount of powder state mold lubricant has to be supplied accruing falling down and accumulation to cause large economical loss.

(2) The powder state mold lubricant is fine particle mixed solid of wax, talc, graphite and the like, and among these components, organic powder is liquefied at about 120° C. On the other hand, melt of aluminum, zinc alloy and the like flows through the sleeve. Therefore, during casting, the temperature of the sleeve can be elevated to about 200° C. In the above, among the powder state mold lubricant supplied into the sleeve from the mold lubricant blowing opening, the organic type powder is liquefied in the sleeve to be accumulated in the bottom of the sleeve. The liquefied powder state mold lubricant accumulated in the sleeve is injected in the cavity in admixed form with the melt supplied into the sleeve via a supply opening. This is not desirable for degradation of quality of product. Furthermore, the liquefied powder state mold lubricant is heated on the mold surface of the cavity to cause large amount of lamp black upon mold opening to cause degradation of working environment.

(3) Upon reducing pressure in the cavity by evacuation through the evacuation port, the supply opening has to be closed to make the cavity into an enclosed chamber.

Accordingly, upon pressure reduction through the evacuation port, it becomes necessary to keep the supply opening which is opened in the cylinder, closed by moving the plunger tip in the cylinder forward and stopped in place. After application of the powder state mold lubricant on the mold surface of the cavity by supplying powder state mold lubricant into the cavity in the vacuum condition through the mold lubricant blowing opening for preparation for injection of melt into the cavity.

As set forth above, upon application of the powder state mold lubricant, it is inherent to drive the plunger tip for forward motion, stopping and backward motion. Therefore, loss should be caused in the cycle time of the die casting operation to cause difficulty in improving production efficiency.

SUMMARY OF THE INVENTION

The present invention has been worked out in view of the problems set forth above. Therefore, it is an object of the present invention to provide an application method of a powder state mold lubricant for a die-casting mold which can effectively apply the powder state mold lubricant onto a mold surface of the mold cavity with supplying the powder state mold lubricant in small amount, can avoid liquefying of the powder mold lubricant to degrade quality of a product, and can avoid loss in cycle time in die-casting operation.

Another object of the present invention is to provide a die-casting apparatus suitable for implementing the powder state mold lubricant application method according to the present invention.

According to the first aspect of the invention, a method for applying a powder state mold lubricant onto a die-casting mold comprises the steps of:

clamping a movable mother die and a stationary mother die to define a mold cavity with a movable insert die and a stationary insert die, in which a plunger tip slidably arranged within a sleeve opens a molten material supply passage, and communication between the sleeve and the mold cavity is blocked;

reducing pressure within the mold cavity by opening a powder suction passage opening into the mold cavity and establishing communication between a powder discharge passage communicated with a powder storage source and the molten material supply passage opening to the mold cavity; and directly supplying the powder state mold lubricant within the powder storage source into the mold cavity via a molten material supply passage for applying the powder state mold lubricant on the mold surface of the mold cavity.

In the first aspect, the pressure within the mold cavity is reduced by the powder suction passage. Toward the mold cavity under vacuum condition, the powder state mold lubricant within the powder storage source is directly supplied via the powder discharge passage and the molten material supply passage, and thus the powder state mold lubricant is applied on the mold surface in the mold cavity. Thus, the powder state mold lubricant may not pass through the sleeve.

In addition to the construction set forth above, according to the second aspect of the invention, in mold clamping condition, the molten material flows from the molten material supply passage into the sleeve.

According to the second aspect of the invention, in the clamping condition, the powder state mold lubricant in the mold cavity is supplied and the powder state mold lubricant is applied on the mold surface of the mold cavity. At this time, the molten material flows into the sleeve through the molten material supply hole, simultaneously. Thus, the injection step is provided.

Also, according to the third aspect of the invention, the powder discharge passage may be cooled at a temperature lower than or equal to a liquefying temperature of the powder state mold lubricant.

According to the third aspect of the invention, the powder state mold lubricant supplied within the mold cavity is cooled at a temperature lower than or equal to a liquefying temperature of the powder state mold lubricant. Thus, floating condition of the powder state mold lubricant can be maintained. Thus, the powder state mold lubricant can be effectively applied on the mold surface of the mold cavity without causing liquefying.

According to the fourth aspect of the present invention, a die-casting apparatus comprises:

a powder control valve guide hole opening in opposition to a sleeve, in which a plunger tip is movably arranged, and formed with an opening communicated with a molten material supply passage on the outer periphery;

a powder control valve establishing communication between a powder discharge passage communicated with a powder storage source and the opening in a condition blocking communication between the opening and the sleeve, and blocking communication between the powder discharge passage and the opening in the condition where the opening and the sleeve is established; and a powder suction passage communicated with a pressure reducing device at one end and opening to the mold cavity at the other end and controlled open and close by means of a switching valve.

According to the fourth aspect of the invention, by the powder control valve movably arranged within the powder control valve guide hole, communication between the opening communicated with the powder control valve guide hole and with the mold cavity, the sleeve and the powder discharge passage is controlled for establishing and blocking. Thus, the die-casting apparatus suitable for implementing the powder mold lubricant application method set forth above, can be provided.

In addition to the fourth aspect of the invention, in the fifth aspect of the invention, the powder control valve guide hole may be coaxially formed with the sleeve in opposition thereto, and the powder control valve movably arranged within the powder control valve guide hole is arranged in opposition of a plunger tip arranged movably within the sleeve.

According to the fifth aspect of the invention, the powder control valve guide hole and the powder control valve can be arranged at a space which has not been used in the conventional die-casting apparatus. This facilitates layout and application for the conventional die-casting apparatus.

In addition to the fourth aspect set forth above, in the sixth aspect of the invention, a cooling cavity in enclosed condition may be formed within the powder control valve may be provided, the powder discharge passage is arranged within the cooling cavity, in the cooling cavity, a cooling liquid may be circulated through a cooling water introducing passage and a cooling water discharge passage.

According to the sixth aspect of the invention, since the powder discharge passage is arranged with the cooling cavity on the powder control valve, in which the cooling liquid is introduced, the powder state mold lubricant passing through the powder discharge passage can be effectively cooled below the liquefying temperature of the powder state mold lubricant. Furthermore, the powder state mold lubricant can be effectively cooled with simple construction.

In addition to the fourth aspect set forth above, in the seventh aspect of the invention, the driving device is constructed with a spring 30, and the powder control valve is resiliently biased toward the sleeve by a spring force of the spring.

According to the seventh aspect of the invention, the operation of the powder control valve can be performed by the spring force of the spring and the injection pressure of the molten material in the sleeve. No particular driving energy is required for driving the driving device.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to be present invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

Figure 1:
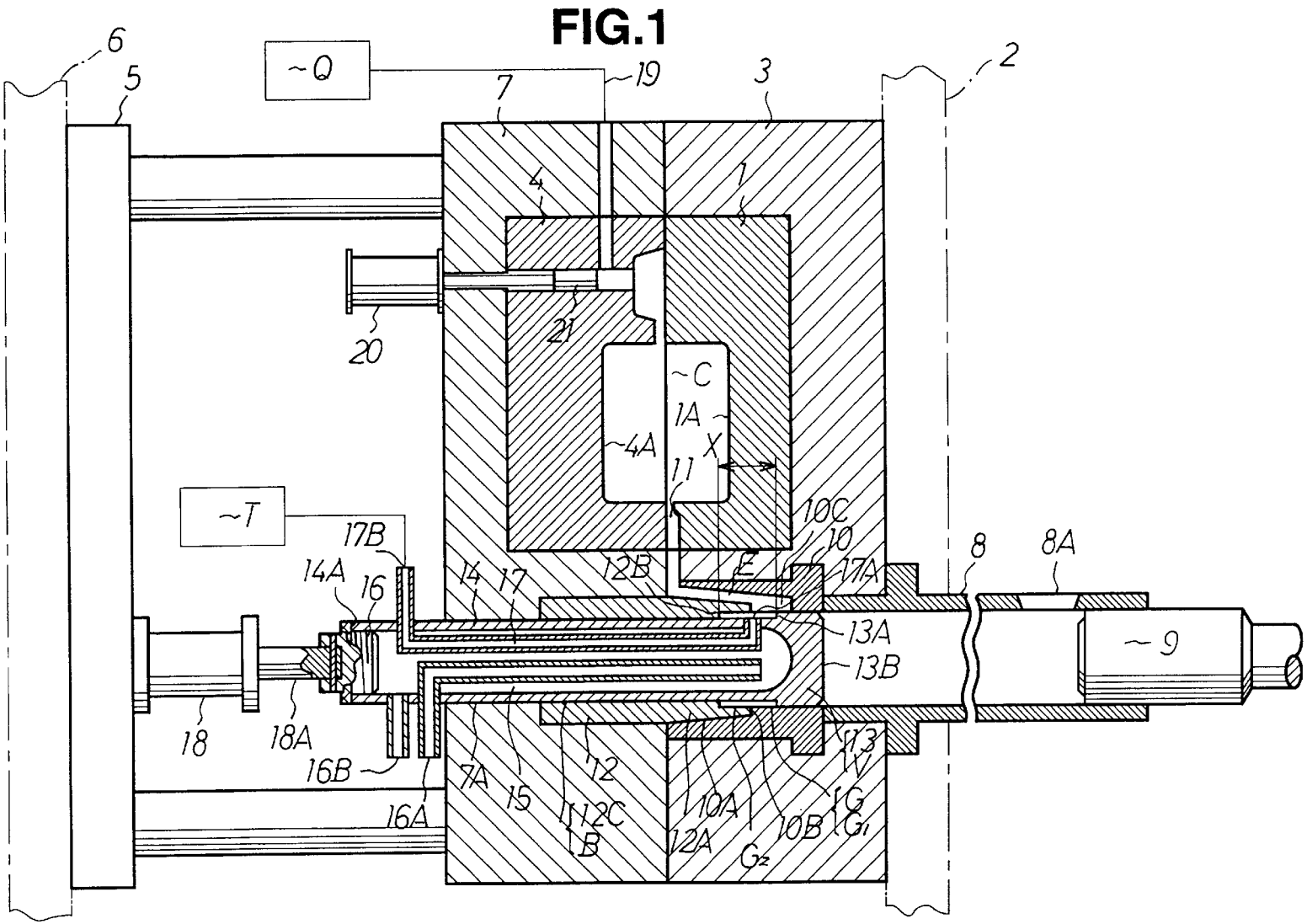
FIG. 1 is a section of the major part of the first embodiment of a die-casting apparatus according to the present invention, which is illustrated in a condition where communication between a sleeve and an opening is blocked by a powder control valve.

FIG. 1 shows a condition in which, after once completing a molding in a molding cavity and removing a product from the molding cavity, a movable mother die is clamped together with a stationary mother die, and then, a molding cavity is defined by a movable insert die and a stationary insert die.

The reference numeral 1 denotes a stationary insert die which is formed with a concave mold surface 1A corresponding to a product surface at one side. The stationary insert die is fixed with a cavity of the stationary mother die 3 which is, in turn, fixed on a stationary base 2 of a casting machine.

The reference numeral 4 denotes a movable insert die having a concave mold surface 4A corresponding to the surface of the product at the other side. The movable insert die 4 is arranged and fixed to a cavity in the movable mother die 7 which is, in turn, fixed to a movable base 6 via a die base 5. By fitting the mating surfaces of the stationary insert die 1 and the movable insert die 4, a molding cavity C defining a space corresponding to the shape of the product with the mold surface 1A of the stationary insert die 1 and the mold surface 4A of the movable insert die 4.

The reference numeral 8 denotes a cylindrical sleeve fixed to the stationary mother die 3 via the stationary base 2. A plunger tip 9 is movably disposed with the sleeve 8. In the drawings, a molten material supply hole 8A is formed in the vicinity of the right side end of the sleeve in communication with the interior of the sleeve 8. The reference numeral 10 denotes a spool bushing fixedly arranged in the stationary mother die 3. The right end of the spool bushing 10 is placed in contact with the left end of the sleeve 8. A powder control valve guide hole Gi extends from the right end toward the left. Also, a guide bushing engaging hole 10A is formed so that a guide bushing extended from the powder control valve guide hole G1 through an engaging step portion 10B toward left, is engaged. The powder control valve guide hole G1 opens in the sleeve 8. The guide bushing engaging hole 10A opens to the left end surface of the stationary mother die 3. In the powder control valve guide hole G1, an opening 10C is formed to open therein. The opening 10C is communicated with the molding cavity C via a molten material supply passage 11. To the movable mother die 7, a guide bushing 12 is fixedly arranged for projecting toward right from the right end surface of the movable mother die 7. The guide projecting portion 12 of the guide bushing projecting from the right end surface of the movable mother die 7 has a shape adapted to engage with the guide bushing engaging hole 10A of the spool bushing 10.

On the other hand, a powder control valve guide hole G2 having the equal diameter to the powder guide control valve hole G1 of the spool bushing 10, is coaxially formed to extend from the right end surface of the guide projection 12A of the guide pushing 12 toward left. A small diameter guide hole 12C is extended from the engaging step portion 12B formed at the left side of the powder control valve guide hole G2 to the left end of the guide bushing 12. A guide hole 7A is formed from the left end of the movable mother die 7 toward the guide hole 12C of the guide bushing 12. The guide hole 12C and the guide hole 7A are the same diameter and formed coaxially with each other.

With the construction set forth above, in the vicinity of the left end of the stationary mother die 3, the spool bushing 10 is arranged. On the left end of the stationary mother die 3, the guide bushing engaging hole 10A of the spool bushing 10 is opened. The engaging step portion 10B and the powder control valve guide hole G1 are opened opposing to the left side end of the stationary mother die 3.

On the other hand, in the vicinity of the right side end of the stationary mother die 3, the sleeve 8 provided with the plunger tip 9 is fixedly arranged. The left end of the sleeve 8 is contacted with the right end of the spool bushing 10. Also, to the sleeve 8, the powder control valve guide hole G1 of the spool bushing 10 is opened. In the shown embodiment, the powder control valve guide hole G1 and the spool bushing 10 are the same diameter and arranged coaxially with each other.

On the other hand, in the vicinity of right side end of the movable mother die 7, the guide bushing 12 is fixedly arranged. The guide projection 12A is projected toward right from the right end of the movable mother die 7. The powder control valve guide hole G2 is formed from the right side end of the guide projection portion 12A toward left. From the engaging step portion 12B formed at the left side of the powder control valve guide hole G2, the guide hole 12C is extended toward left. To the guide hole 12C of the guide bushing 12, the guide hole 7A formed with opening to the left side end of the movable mother die 7 is arranged coaxially in communication therewith.

The stationary mother die 3 and the movable mother die 7 are clamped with mating the left side end of the stationary mother die 3 and the right side end of the movable mother die 7. The guide projection portion 12A of the guide bushing 12 is engaged in the guide bushing engaging hole 10A of the spool bushing 10. The right end of the guide projection portion 12A is placed in contact with the engaging step portion 10B of the spool bushing 10.

On the other hand, the powder control valve guide hole G1 of the spool bushing 10 and the powder control valve guide hole G2 if the guide bushing 12 are coaxially connected to form a powder control valve guide hole G. The guide hole 12C of the guide bushing 12 and the guide hole 7A of the movable mother die 7 are arranged coaxially.

Namely, by integrating the powder control valve guide hole G1 and the powder control valve guide hole G2 are integrally coupled, the single powder control guide hole G is formed. Also, by integrally coupling the guide hole 12C and the guide hole 7A, a single guide hole B is formed. Also, the sleeve 8 is formed coaxially with the powder control valve guide hole G1 of the spool bushing 10, and is communicated with the powder control valve guide hole G1. On the other hand, the left side end of the movable mother die 7, the guide hole 7A is opened.

Also, the opening 10C opening in the powder control valve guide hole G1 is communicated with the molten material supply passage 11 via a passage E defined by the inner peripheral portion of the guide bushing engaging hole 10A and the outer periphery of the guide projection portion 12A. The molten material supply passage 11 opens within the molding cavity C.

Within the powder control valve guide hole G (defined by G1 and G2) formed within the spool bushing 10 and the guide bushing 12 and the guide hole 12 (defined by 12C and 7A) formed within the guide bushing 12 and the movable mother die 7, a powder control valve V is movably arranged. The powder control valve V is formed with a cylindrical valve portion 13 at the right side end and a sliding cylindrical portion 14 toward left from the cylindrical valve portion 13.

The cylindrical valve portion 13 is designed to move within the guide hole G with tightly contacting with the guide hole G. The sliding cylindrical portion 14 having smaller diameter than that of the cylindrical valve portion 13 and slidably disposed within the guide hole B, is extended toward left from a stepping down portion 13A located at the left side of the cylindrical valve portion 13. The right side end 13B of the cylindrical valve portion 13 is arranged in opposition to the sleeve 8. The powder control valve V is moved corresponding to a distance X to contact the stepping down portion 13A of the cylindrical valve portion 13 onto the engaging step portion 12B of the guide bushing 12.

The reference numeral 15 denotes a cooling cavity recessed in the vicinity of the right side end 13B of the cylindrical valve portion 13 from the left side end 14A (left end of sliding cylindrical portion 14) of the powder control valve V. Opening of the cooling cavity 15 to the left side end 14A is closed by a closure plug 16. Accordingly, the cooling cavity 15 is an enclosed chamber. Then, within the cooling cavity 15, a cooling water introduction passage 16A and a cooling water drain passage 16B are opened. The cooling liquid is supplied in the cooling cavity 15 from the cooling water introduction passage 16A. The cooling liquid is circulated within the cooling cavity 15. Thereafter, the cooling water is drained through the cooling water drain passage 16B. Thus, the inside of the cooling cavity 15 is maintained in constant temperature condition.

The reference numeral 17 denotes a powder discharge passage disposed within the cooling cavity 15. A discharge opening 17A of the powder discharge passage 17 opens to the outer periphery. An inflow opening 17B is communicated with a powder storage source T.

The reference numeral 18 denotes a driving device, such as an air cylinder, a hydraulic cylinder or so forth, for performing position control of the powder control valve V/ An output rod 18A of the driving device is mounted on the closure plug 16.

In the condition where the output rod 18A of the driving device 18 is further expanded toward right, the powder control valve V is rightmost position in the drawing. The cylindrical valve portion 13 blocks communication between the sleeve 8 and the opening 10C and establish communication 10C with the ejection opening 17A of a powder discharge passage 17. On the other hand, in the condition contracting the output rod 18A toward left, the powder control valve V is located at the left side position in the drawing, and the stepped done portion 13A of the cylindrical valve portion 13 contacts the engaging step portion 12B of the powder control valve guide hole G2.

Figure 2:
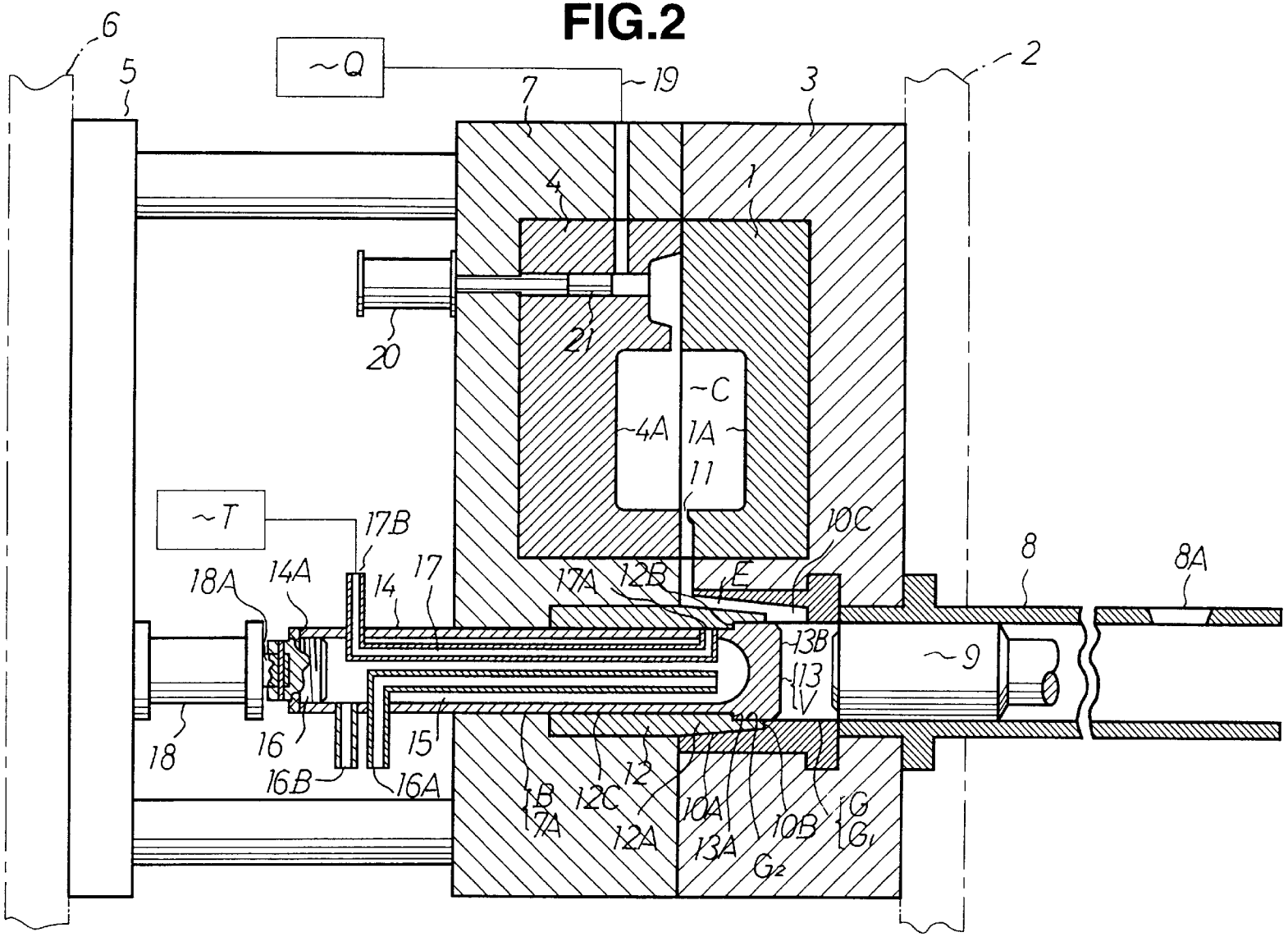
FIG. 2 is a section similar to FIG. 1 but showing a condition where the communication between the sleeve and the opening is established by the powder control valve.

This condition is illustrated in FIG. 2 which will be discussed later.

The reference numeral 19 denotes a powder suction passage opening to the molding cavity C at one end and communicated with a pressure reduction device Q, such as a vacuum pump or so forth, at the other end. The powder suction passage is operated is opened and closed by a switching valve 21 driven by a driving device 20, such as an electromagnet, air-cylinder and so forth.

Next, the operation will be discussed hereinafter.

One cycle of casting process in a die-casting is generally separated into a mold lubricant applying step, a molten material supplying step, an injection step, a solidifying step and a product removing step. The mold lubricant applying step (for convenience, the mold lubricant applying step is assumed as the first step) is a step for applying a mold lubricant on a mold surface of the molding cavity. The molten material supplying step is a step pouring a molten material through a molten material supply hole within the sleeve. The injection step is step for injecting the molten material supplied to the sleeve into the cavity via a molten material supply passage by shifting the plunger tip. The solidifying step is a step for solidifying the molten material injected into the mold cavity. The product removing step is a step removing the product solidified in the cavity.

Here, respective process steps will be discussed in detail.

At first, discussion will be given for the mold lubricant application step.

The movable mother die 7 and the stationary mother die 3 are mated and clamped, and then the stationary insert die and the movable insert die are mated for defining the mold cavity C. At this time, the plunger tip 9 abuts with the right end of the sleeve 8 to open the molten material hole 8A.

Then, by driving the driving device 18, an output rod 18A is expanded to forward the powder control valve V toward right in FIG. 1. At this condition, the right side end 13B of the cylindrical valve portion 13 is located mating with the sleeve 8, and the cylindrical valve portion 13 is arranged in tight fitting on the powder control valve guide hole G1 opposing the sleeve 8. The cylindrical valve portion 13 blocks opening 10C communicating the sleeve 8 and the molten material supply passage 11.

On the other hand, the discharge opening 17A of the powder discharge passage 17 opens to the powder control valve guide valve G from the outer periphery of the sliding cylindrical portion 14 and communicates with the opening 10C opening in the powder control valve guide hole G. The opening 10C is communicated with the mold cavity C via the passage E and the molten material supply passage 11. Namely, the powder discharge passage 17 is communicated with the mold cavity C. At this condition, a cooling liquid is introduced into the cooling cavity 15 by the cooling water introducing passage 16A. The cooling liquid is circulated within the cooling cavity 15 and thereafter again discharged from the cooling water discharge passage 16B. The liquid temperature in the cooling cavity 15 is maintained at a temperature lower than or equal to a melting temperature of an organic type powder contained in the powder state mold lubricant, e.g. lower than or equal to 120° C.

Supply of the cooling liquid into the cooling cavity 15 has to be performed at least in the application step of the mold lubricant. In the subsequent step, discussion for supplying the cooling liquid will be neglected. Also, the driving device 20 is driven to move the switching valve 21 in the drawing to open the powder suction passage 19 to establish communication between the molding cavity C and the pressure reducing device Q via the powder suction passage 19.

In such condition, by driving the pressure reducing device Q, the vacuum is introduced into the molding cavity C for situating the mold cavity in vacuum condition. The lowered pressure in the molding cavity C acts to the discharge opening 17A of the powder discharge passage 17 via the molten material supply passage 11, the passage E, the opening C and the powder control valve guide G.

As set forth above, in the powder storage source T, the powder state mold lubricant, such as wax, talc, graphite and the like, in super fine solid in floating condition to flow by air is sucked into the opening 10C through the powder discharge passage 17, the discharge opening 17A and the powder control valve guide hole G, and further sucked into the mold cavity C from the opening 10C via the passage E and the molten material passage 11. Thus, the molding cavity C is filled with the powder state mold lubricant.

Then, the powder state mold lubricant within the molding cavity collides on the mold surfaces 1A and 4A to be applied on the mold surface.

On the other hand, the powder state mold lubricant residing in the mold cavity C is sucked toward the pressure reducing device Q via the powder suction passage 19.

A period for reducing the pressure within the molding cavity C by the pressure reducing device Q, in other words, a period for applying the powder state mold lubricant on respective mold surfaces 1A and 4A by supplying the powder state mold lubricant into the molding cavity C may be set at an optimal period depending upon surface structure of the molding cavity C and capacity of the molding cavity C. After expiration of the given period, the switching valve 21 is driven by the driving device 20 to close the powder suction passage 19. When the powder suction passage 19 is closed, vacuum condition in the molding cavity C is released. Therefore, supply of the powder state mold lubricant into the molding cavity from the powder discharge passage 17 is automatically stopped.

In the powder state mold lubricant application step, the powder mold lubricant passing through the powder discharge passage 17 is cooled to a temperature condition lower than or equal to a given temperature by the cooling liquid circulated within the cooling cavity 15.

Namely, when a fine particle mixture sold of wax, talc, graphite or the like is employed as the powder state mold lubricant, among these components, the organic type powder may liquefy at about 120° C. Therefore, by cooling the powder discharge passage 17 by the cooling liquid in the cooling cavity 15 so that the temperature of the powder state mold lubricant passing through the powder discharge passage 17 becomes lower than or equal to 120° C. Thus, liquefying of the powder state mold lubricant can be successfully prevented.

As set forth above, the powder state mold lubricant will never be liquefied in the powder discharge passage 17. Thus, the powder state mold lubricant in floating condition can be supplied into the molding cavity C from the discharge opening 17A of the powder discharge passage 17 through the opening 10C, the passage E and the molten material passage 11. Accordingly, the powder state mold lubricant supplied from the powder storage source T may not be retained within the intermediate supply piping and all can be supplied into the molding cavity C, and thus achieves economical effect.

On the other hand, avoiding liquefying of the powder state mold lubricant permits supply of the powder state mold lubricant in fine particle condition into the molding cavity. Thus, the powder state mold lubricant can be applied uniformly over the entire surface of the mold surfaces 1A and 4A of the molding cavity C without no portion remained in non-applied.

Next, molten material supply step. In the molten material supplying or teeming step, the powder control valve V and the plunger tip 9 are held in the same conditions as those in the mold lubricant application step.

Namely, at the position shifted toward right of the powder control valve V, the cylindrical valve portion 13 is tightly fitted to the powder control valve guide G1 of the spool bushing 10 to block communication between the sleeve 8 and the opening 10C.

On the other hand, the plunger tip 9 opens the molten material supply opening 8A at the right side end of the sleeve 8. Then, a desired amount of the molten material is supplied from the molten material supply hole 8A to the sleeve 8. The foregoing is the molten material supply step of the molten material into the sleeve 8, such molten material supply step and the mold lubricant applying step can be performed simultaneously. This is because that the powder control valve V is in the rightwardly shifted position, the cylindrical valve portion 13 blocks communication between the sleeve 8 and the opening 10C, and the discharge opening 17A of the powder discharge passage 17 is communicated with the opening 10C.

Next, injection step will be discussed.

In the injection step, the switching valve 21 closes the powder suction passage 19 by the driving device 20.

The plunger tip 9 is shifted toward left in the drawing for reducing the volume in the sleeve 8 according to shifting of the plunger tip 9. On the other hand, in such injection step, the powder control valve V is driven toward left by the driving device 18. The cylindrical valve portion 13 is shifted toward left in the distance X. Then, the stepped down portion 13A abuts to the engaging step portion 12B of the guide bushing 12 and then movement of the powder control valve toward left is stopped. The position of the powder control valve V is shown in FIG. 2. By this, the cylindrical valve portion 13 of the powder control valve V establishes communication between the sleeve 8 and the opening 10C. On the other hand, the discharge opening 17A of the powder discharge passage 17 is closed by the guide hole 12C of the guide bushing 12. In conjunction therewith, the cylindrical valve portion 13 is in tightly fitted on the powder control value guide hole G (mainly the powder control valve guide hole G2 of the guide bushing 12). Thus, communication between the powder discharge passage 17 and the opening 10C, is blocked. As set forth above, the shifting timing of the powder control valve V toward left is synchronized to initiate shifting toward left of the plunger tip 9, or in the alternative, after passing the plunger tip 9 through the molten material hole 8A. The powder control valve V should be shifted toward left at least before the high speed injection at the final injection stage of the plunger tip 9.

Then, the plunger tip 9 is further shifted toward left within the sleeve 8, the molten material in the sleeve 8 is pressurized and injected into the mold cavity C via the opening 10C, the passage E and the molten material supply passage 11. This condition is illustrated in FIG. 2.

After completion of injection step, the mold is held in clamped condition for a predetermined period. During this period, the molten material injected into the mold cavity C is cooled and solidified. This is the solidifying step.

Next step is the product removing step. In advance of removal of the cast block, the movable mother die 7 is released away from the stationary mother die 3 to be in the unclamped position. Thus, the product solidified in the mold cavity C and thus cast is moved together with the movable mother die in the adhering position on the mold surface 4A of the cavity C of the movable insert die 4. Thereafter, by means of a not shown pushing pin, the cast product is pushed out of the mold surface 4A of the movable insert die. Thus, the product can be removed from the die.

It should be noted that molten material and the product are illustrated in blank form.

As set forth above, by the application method of the powder state mold lubricant according to the present invention, the following particular effects.

(1) The powder state mold lubricant is supplied into the mold cavity C from the discharge opening 17A of the powder discharge it passage 17 through the annular powder control valve guide hole G having fine gap, the opening 10C of the spool bushing 10, the passage E in a form of fine groove defined on a part of the external peripheral portion of the guide cylindrical portion 12A and a part of the internal peripheral portion of the spool bushing 10 and the molten material supply passage 11.

With the construction set forth above, the powder state mold lubricant passes through passages having small volume, the flow velocity of the powder state mold lubricant can be increased so that the powder state mold lubricant may not fall down to be accumulated therein. Accordingly substantially all of the powder state mold lubricant supplied from the powder discharge passage 17 can be supplied to the mold cavity. This makes it unnecessary to supply large amount of powder state mold lubricant in consideration of falling down and accumulation in the passage and thus can achieve significant economical effect.

(2) Since the powder state mold lubricant may not falls down in respective passages, the accumulated powder state mold lubricant may not be admixed the molten material upon injection of the molten material. Thus, quality of cast product can be improved.

(3) The powder state mold lubricant flowing through the powder discharge passage 17 is cooled to be lower than or equal to the predetermined temperature by a cooling liquid and sucked from the discharge opening 17A.

As set forth above, the organic type powder as a component of the powder state mold lubricant can be maintained at a temperature condition lower than or equal to the liquefying temperature, the powder state mold lubricant may not be liquefied within the passage from the discharge opening 10C to the mold cavity C. Since the powder state mold lubricant may not be liquefied, the liquefied powder state mold lubricant may not be admixed the molten material upon injection of the molten material. Thus, quality of cast product can be improved.

(4) Suppression of liquefying of the powder state mold lubricant, upon unclamping after molding, the oil smoke due to liquefied powder state mold lubricant will never be generated to significantly improve working environment. Furthermore, it becomes unnecessary to install large scale scavenger facility.

(5) In the mold lubricant application step, forward and backward motion and stopping of the plunger tip for application of the mold lubricant becomes unnecessary. By this, a cycle time of casting operation from application of the mold lubricant to removal of the product can be shortened to improve production efficiency.

(6) In the condition where the powder control valve V is shifted toward right by the driving device 18, by the cylindrical valve portion 13, communication between the sleeve 8 and the opening 10C can be blocked, and the discharge opening 17A of the powder discharge passage 17 and the opening 10C are communicated. The powder state mold lubricant application step and the mold material supplying step can be performed simultaneously. Accordingly, the cycle time of the casting operation can be significantly shortened to improve production ability and to lower the casting cost.

(7) The powder control valve guide hole G is communicated with the sleeve 8, the opening 10C connected to the molten material supply passage 11 is formed on the outer periphery. Within the powder control valve guide hole G, the powder control valve V establishing and blocking communication between the opening 10C, the sleeve 8 and the discharge opening 17A of the powder discharge passage 17 is movable discharged. The construction is quite simple. Therefore, implementation for the conventional mother die becomes easy. Amongst, by coaxially arranging the longitudinal axis of the sleeve 8 and the longitudinal axis of the powder control valve guide hole G, and arranging the powder control valve V along the longitudinal axis, it is suitable for down-sizing of the overall apparatus including the powder control valve V.

On the other hand, in order to maintain the powder state mold lubricant lower than or equal to the predetermined temperature, the cooling cavity 15 storing the cooling liquid within the powder control valve G can be formed. The powder discharge passage 17 is arranged within the cooling cavity. Thus, the powder state mold lubricant can be effectively maintained in the temperature condition lower than or equal to the predetermined temperature. Furthermore, the device for cooling the powder state mold lubricant can be construction in quite simple structure and thus can be formed compact. Also, implementation on the conventional mother die becomes easy.

Figure 3:
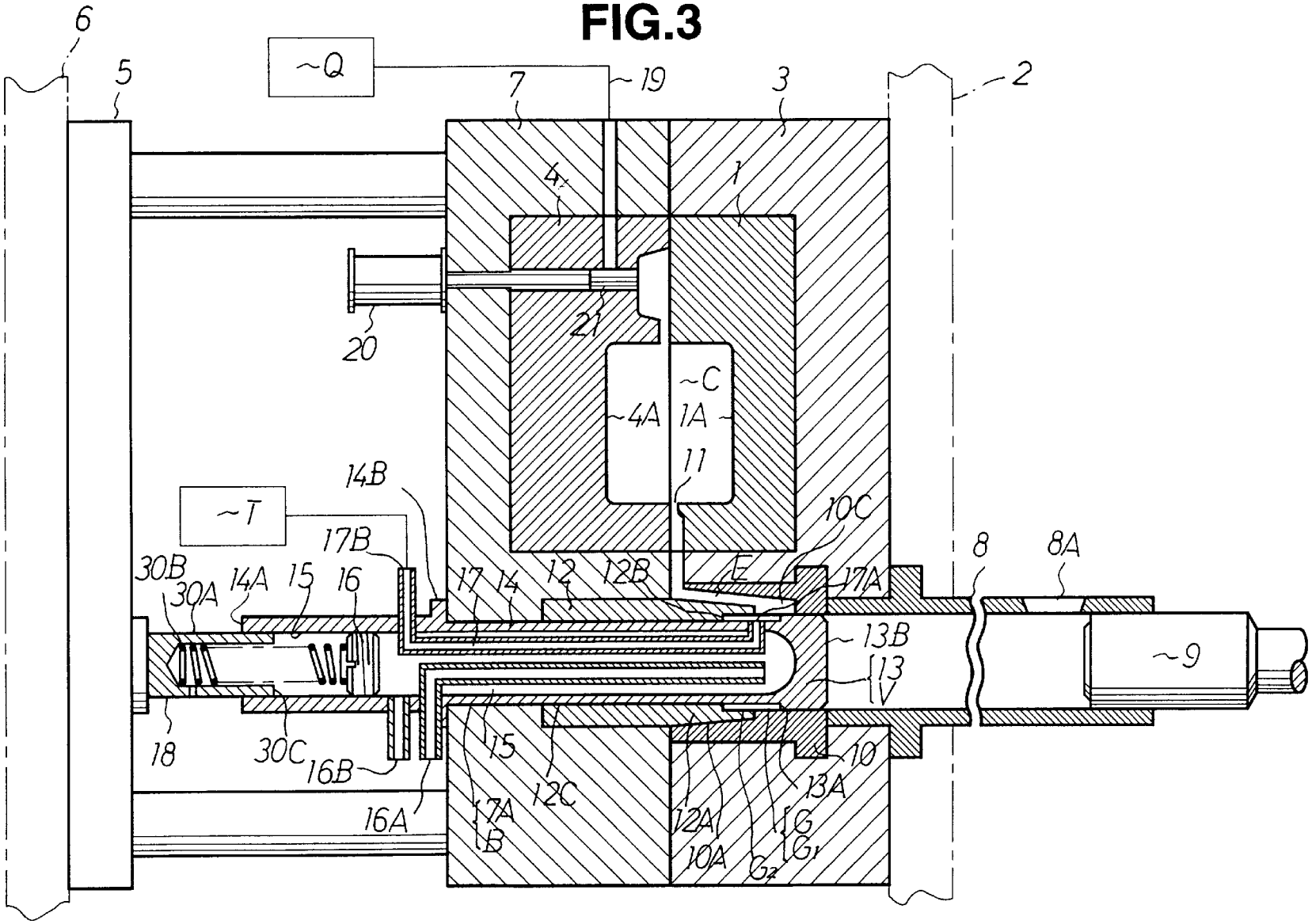
FIG. 3 is a section showing the major part of the second embodiment of the die-casting apparatus according to the present invention.

FIG. 3 shows another embodiment of the die-casting apparatus according to the present invention. The shown embodiment is differentiated from the first embodiment shown in FIG. 1 in a driving device for driving the powder control valve V. The following discussion will be given only for the portion different from the first embodiment in order to keep the disclosure simple enough to facilitate clear understanding of the invention. The driving device 18 is constructed with a cylindrical portion 30A and a spring 30B. The basic portion of the cylindrical portion 30A is fixed on the die base 5. The cylindrical portion 30A horizontally extending toward right is slidably disposed within the cooling cavity 15 opening to the left end 14A of the powder control valve V.

On the other hand, the cooling cavity 15 of the powder state mold lubricant is closed by the closure plug 16 at a position slightly shifted toward right from the opening of the cooling water discharge passage 16B.

By this, the cooling cavity 15 located at the right side of the closure plug 16 and closed, is formed. In the left side of the closure plug 16, the cooling cavity 15 opening to the left end 14A and slidably holding the cylindrical portion 30A of the driving device 18, can be defined. Then, the spring 30B is disposed between the cylindrical portion 30A and the left side of the closure plug 16 in compressed fashion.

With the construction set forth above, the powder control valve V is biased toward right by the spring 30B. The right side position is determined by abutting the engaging shoulder portion 14B of the powder control valve V on the left end surface of the movable mother die 7.

Then, in the mold lubricant application step, the powder control valve V is pushed toward right by the spring 30B to be placed at the rightwardly shifted position as shown in FIG. 3. Then, communication between the sleeve 8 and the opening 10C is blocked, and the discharge opening 17A of the powder discharge passage 17 and the opening 10C are communicated. The powder suction passage 19 is opened by the switching valve 21.

Similarly to the first embodiment, the powder state mold lubricant is supplied within the mold cavity C, and the powder state mold lubricant is applied on the mold surfaces 1A and 4A of the mold cavity C. Then, in the injection step, the plunger tip 9 moves toward left within the sleeve to shift into the high speed injection at the final stage in the injection step. Then, the molten material filled within the sleeve pushes the right end 13B of the powder control valve V toward left against the spring force of the spring 30B to shift the powder control valve V toward left. By this, similarly to the first embodiment, the sleeve 8 and the opening 10C are communicated. And the discharge opening 17A of the powder discharge passage 17 and the opening 10C are blocked from communication. Accordingly, the pressurized molten material in the sleeve 8 is injected into the mold cavity via the opening 10C, the passage E and the molten material supply passage 11. By this, injection step is completed. Subsequently, the solidification step and product removing step are performed similarly to the first embodiment. By the second embodiment, the driving device can be constructed in simple structure and low cost. Particularly, electric power, hydraulic pressure or pneumatic pressure is not required for driving the driving device. The powder state mold lubricant is supplied from the powder suction passage 19 to the mold cavity C. The powder state mold lubricant in the mold cavity V is sucked and discharged through the powder discharge passage 17.

According to the method for applying a powder state mold lubricant onto a die-casting mold, according to the present invention, a movable mother die and a stationary mother die are clamped to define a mold cavity with a movable insert die and a stationary insert die, in which a plunger tip slidably arranged within a sleeve opens a molten material supply passage, and communication between the sleeve and the mold cavity is blocked; a pressure within the mold cavity is reduced by opening a powder suction passage opening into the mold cavity and establishing communication between a powder discharge passage communicated with a powder storage source and the molten material supply passage opening to the mold cavity; and the powder state mold lubricant is directly within the powder storage source into the mold cavity via a molten material supply passage for applying the powder state mold lubricant on the mold surface of the mold cavity. With such constriction, the powder state mold lubricant will not pass through the chamber or passage having large volume but pass through passages having small volume, the powder state mold lubricant will never fall down to be accumulated within the passage. Therefore substantially overall powder state mold lubricant can be supplied from the powder discharge passage. Therefore, wasting of the powder state mold lubricant is little to improve economical effect. Furthermore, since the powder state mold lubricant will never be admixed with the molten material upon injection of the latter in the sleeve into the mold cavity. Thus, the quality of the cast product becomes high and stable.

In the clamped condition, by inflow of the molten material into the sleeve from the molten material supply passage, the molten material supply process can be performed simultaneously with application process of the powder state mold lubricant. Thus, cycle time in casting operation van shortened to achieve improvement of production efficiency and lowing of production cost.

By cooling the powder discharge passage 17 to a temperature lower than the liquefying temperature of the powder state mold lubricant, the organic powder as component of the powder state mold lubricant can be maintained at the temperature condition lower than or equal to the liquefying temperature. Therefore, the powder state mold lubricant will never be liquefied in the passage to reach the mold cavity. Accordingly, the powder state mold lubricant may not be admixed with the molten material. Thus the cast with high quality and high stability.

Furthermore, upon unclamping of the mold after forming, oil smoke which is otherwise generated by the liquefied powder state mold lubricant, and thus work environment can be improved significantly.

According to the present invention, there is also provided a die-casting apparatus suitable for implementing the foregoing powder state mold lubricant application method, comprises:

a powder control valve guide hole opening in opposition to a sleeve, in which a plunger tip is movably arranged, and formed with an opening communicated with a molten material supply passage on the outer periphery;

a powder control valve establishing communication between a powder discharge passage communicated with a powder storage source and the opening in a condition blocking communication between the opening and the sleeve, and blocking communication between the powder discharge passage and the opening in the condition where the opening and the sleeve is established; and a powder suction passage communicated with a pressure reducing device at one end and opening to the mold cavity at the other end and controlled open and close by means of a switching valve.

Particularly, since the powder control valve guide hole is formed coaxially with the sleeve in opposition to the latter, and the powder control valve is movably arranged within the powder control guide hole, it can be quite easily implemented with the conventionally used mold (particularly the movable mother die). Also, the overall apparatus including the powder control valve guide hole and the powder control valve can be made compact. In other word, the powder control valve guide hole and the powder control valve can be disposed in a space which has not bee used in the conventional apparatus. On the other hand, by providing the molding cavity in the enclosed condition within the closed condition in the control valve, and the cooling liquid is circulated within the cooling cavity by the cooling liquid introducing passage, the cooling water discharge passage. Thus, the powder state mold lubricant can be effectively maintained at the temperature lower than or equal to the first embodiment. Also, the device for cooling the powder state mold lubricant can be easily can be reduced in size, and implementation for the conventional mother die.

Also, by forming the driving device with the spring, and the powder control valve is elastically or resiliently biases by the spring force of the spring. This, any driving energy, such as electric power, hydraulic power or pneumatic color becomes unnecessary to contribute for simplification and down sizing of the driving device.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A method for applying a powder state mold lubricant to a die-casting mold comprising the steps of:

clamping a movable mother die and a stationary mother die to define a mold cavity with a movable insert die and a stationary insert die, in which a plunger tip slidably arranged within a sleeve opens a molten material supply hole, and communication between said sleeve and said mold cavity is blocked;

reducing pressure within said mold cavity by opening a powder suction passage opening into said mold cavity and establishing communication between a powder discharge passage communicated with a powder storage source and a molten material supply passage opening to said mold cavity; and directly supplying the powder state mold lubricant within said powder storage source into said mold cavity via the molten material supply passage for applying the powder state mold lubricant on the mold surface of said mold cavity.

2. A method for applying a powder state mold lubricant to a die-casting mold as set forth in claim 1, wherein, in mold clamping condition, molten material flows from said molten material supply into the sleeve.

3. A method for applying a powder state mold lubricant to a die-casting mold as set forth in claim 1, wherein said powder discharge passage is cooled at a temperature lower than or equal to a liquefying temperature of said powder state mold lubricant.

4. A die-casting apparatus comprising:

a powder control valve guide hole opening in opposition to a sleeve, in which a plunger tip is movably arranged, and formed with an opening communicated with a molten material supply passage on the outer periphery;

a powder control valve establishing communication between a powder discharge passage communicated with a powder storage source and said opening in a condition blocking communication between said opening and said sleeve, and blocking communication between said powder discharge passage and said opening in the condition where said opening and said sleeve is established; and a powder suction passage communicated with a pressure reducing device at one end and opening to said mold cavity at the other end and controlled open and close by means of a switching valve.

5. A die-casting apparatus as set forth in claim 4, wherein said powder control valve guide hole is coaxially formed with said sleeve in opposition thereto, and said powder control valve movably arranged within said powder control valve guide hole is arranged in opposition of the plunger tip arranged movably within said sleeve.

6. A die-casting apparatus as set forth in claim 4, wherein a cooling cavity in enclosed condition is formed within said powder control valve is provided, said powder discharge passage is arranged within said cooling cavity, in said cooling cavity, a cooling liquid is circulated through a cooling liquid introducing passage and a cooling liquid discharge passage.

7. A die-casting apparatus as set forth in claim 4, further comprising a driving device constructed with a spring and the powder control valve is resiliently biased toward said sleeve by a spring force of said spring.

* * * * *